US007824282B2

(12) United States Patent
Wycoff

(10) Patent No.: US 7,824,282 B2
(45) Date of Patent: Nov. 2, 2010

(54) VOLLEYBALL APPROACH AND HIT TRAINER

(76) Inventor: Lester Elmer Wycoff, 109 E. Sycamore St., Three Oaks, MI (US) 49128

( * ) Notice: Subject to any disclaimer, the term of this patent is extended or adjusted under 35 U.S.C. 154(b) by 0 days.

(21) Appl. No.: 12/494,635

(22) Filed: Jun. 30, 2009

(65) Prior Publication Data

US 2010/0009784 A1 Jan. 14, 2010

Related U.S. Application Data

(60) Provisional application No. 61/134,233, filed on Jul. 9, 2008.

(51) Int. Cl.
*A63B 69/00* (2006.01)

(52) U.S. Cl. ..... 473/473; 473/423; 473/429; 473/430

(58) Field of Classification Search ..... 473/473, 473/422, 423, 429, 430
See application file for complete search history.

(56) References Cited

U.S. PATENT DOCUMENTS

| | | | | | |
|---|---|---|---|---|---|
| 3,716,235 | A * | 2/1973 | Yerkie, Jr. | ..... | 473/429 |
| 4,372,561 | A * | 2/1983 | Morgan et al. | ..... | 473/426 |
| 4,881,742 | A * | 11/1989 | Hargreave | ..... | 473/575 |
| 4,948,150 | A * | 8/1990 | Daly et al. | ..... | 473/430 |
| 5,823,895 | A * | 10/1998 | Rasic | ..... | 473/430 |
| 5,913,739 | A * | 6/1999 | Brenneisen | ..... | 473/430 |
| 5,957,781 | A * | 9/1999 | Kelly | ..... | 473/140 |
| 6,171,205 | B1 * | 1/2001 | Hummel | ..... | 473/459 |
| 6,672,979 | B2 * | 1/2004 | Brenneisen | ..... | 473/430 |
| 7,041,016 | B1 * | 5/2006 | Omtvedt | ..... | 473/426 |
| 2001/0003106 | A1 * | 6/2001 | Brenneisen | ..... | 473/430 |
| 2005/0037874 | A1 * | 2/2005 | McCoy | ..... | 473/430 |
| 2010/0009784 | A1 * | 1/2010 | Wycoff | ..... | 473/429 |

* cited by examiner

*Primary Examiner*—Raleigh W. Chiu
(74) *Attorney, Agent, or Firm*—Babcock IP, PLLC

(57) ABSTRACT

A volleyball approach and hit trainer mountable upon a volleyball net provided with a ball coupled to a cord coupled to a frame at a connection point. The ball retained above and offset forward of the top of the volleyball net, rotatable around the connection point.

19 Claims, 2 Drawing Sheets

VOLLEYBALL APPROACH AND HIT TRAINER

CROSS REFERENCE TO RELATED APPLICATIONS

This application claims the benefit of U.S. Provisional Patent Application No. 61/134,233, "(Shag-Less) Volley Ball Approach and Hit Perfector", by Lester Elmer Wycoff filed Jul. 9, 2008—currently pending and hereby incorporated by reference in its entirety.

BACKGROUND

1. Field of the Invention

This invention relates to the sport of volleyball. More particularly, the invention relates to an approach and hit training apparatus suspendable upon a volleyball net.

2. Description of Related Art

One aspect of volleyball training is improving approach and strike skills related, for example, to the common volleyball spike maneuver where the player moves across the court, leaps and strikes the ball over the net, downward toward the opponents court. Training for the spike maneuver typically requires multiple players and/or trainers repeatedly tossing the ball near the top of the volleyball net, so the player can practice/refine the approach and strike mechanics again and again.

A ball tossed in the air introduces an additional timing requirement to the approach and strike mechanics, increasing the complexity of the maneuver and preventing repeated refinement by the player of a strike upon a ball located at a specific location with respect to the net. Further, the requirement for multiple players and/or a trainer prevents individuals from training on the spike maneuver when they are alone.

Prior volleyball approach and strike training apparatus typically suspend a ball from a cord suspended from a large floor mounted frame. The frame has significant structural requirements supporting itself and resisting the ball strike forces applied to the ball by the player, from the floor to the connection point of the ball. The frame typically has an extension characteristic, supporting the ball over an open space, so the player does not contact the frame during the approach and/or landing. These large frames are unwieldy, expensive and require significant storage space when not in use. Because the prior frames rely upon a smooth flat floor for support, they are difficult to use, if at all, on exterior/sand volleyball courts.

Therefore, it is an object of the invention to provide a volleyball approach and strike training apparatus that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that the volleyball net may be utilized as a structural support for an approach and hit trainer, enabling a significant simplification of the frame requirements of a volleyball approach and hit trainer. Thereby, the required frame is dramatically simplified, any frame obstructions in the approach and hit trainer landing area of the volleyball court may be eliminated and a stable court surface is no longer required.

Figure 1:
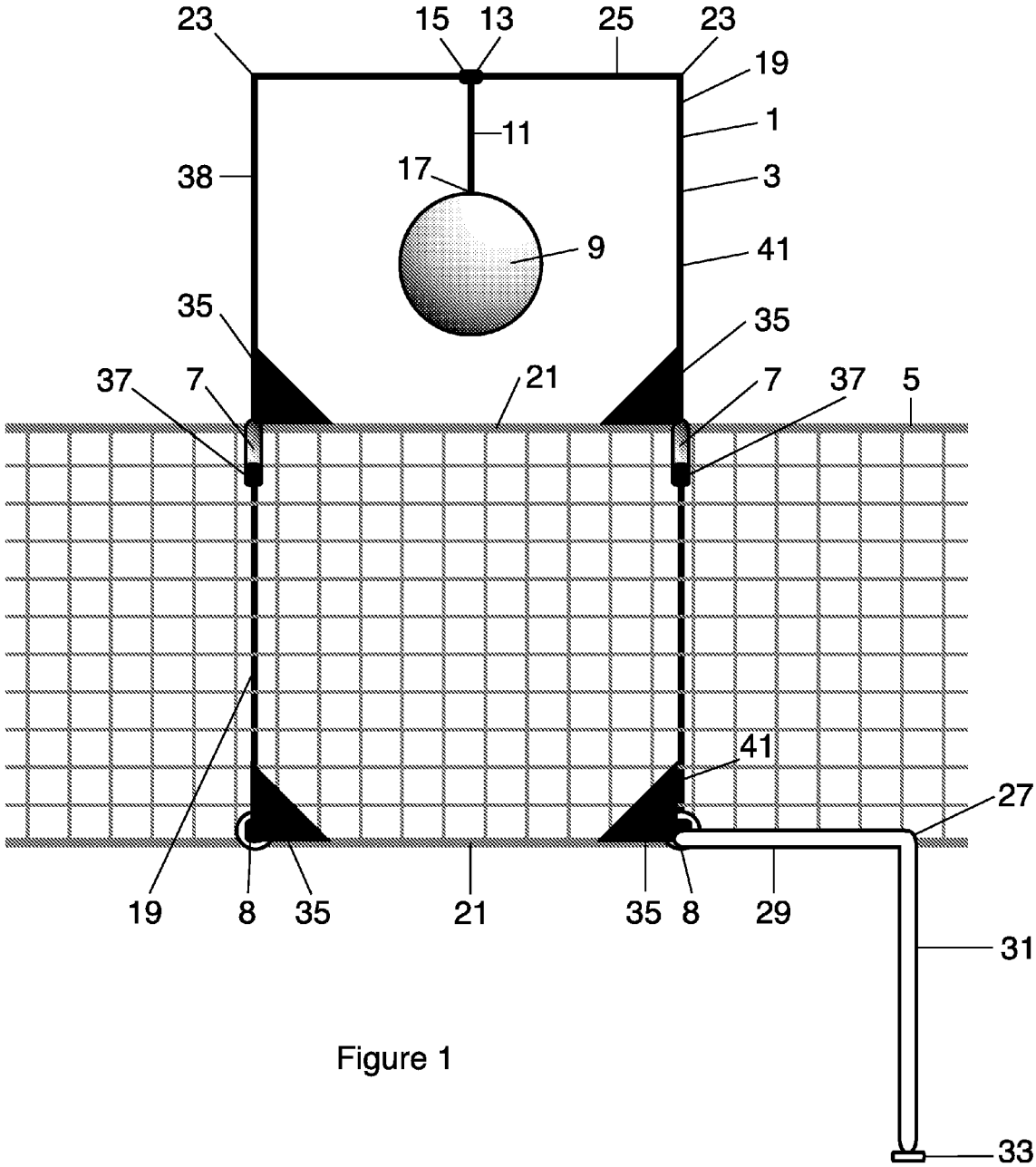
FIG. 1 is a schematic front view of an exemplary embodiment demonstrated installed on a volleyball net.
Figure 2:
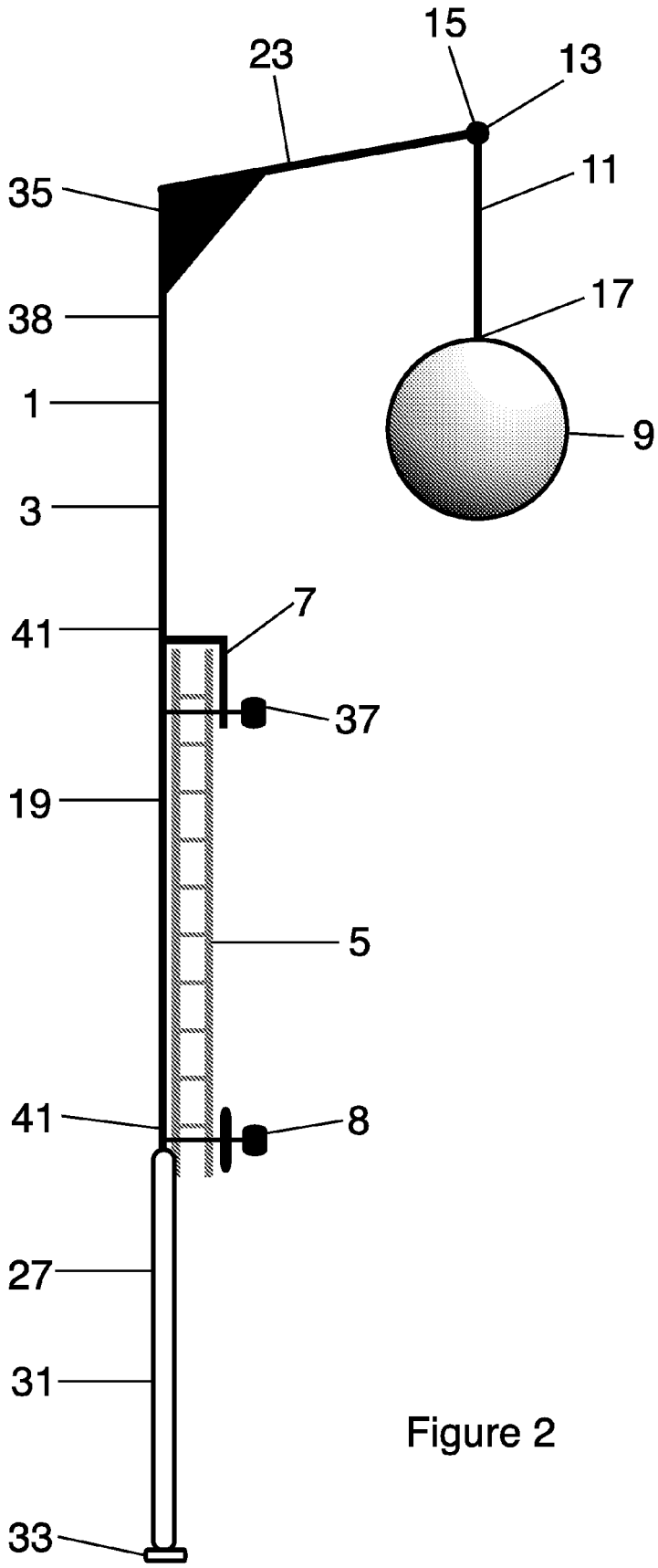
FIG. 2 is a side view of FIG. 1.

An exemplary embodiment of an approach and hit trainer 1 is demonstrated in FIGS. 1 and 2. A frame 3 is configured to attach to the volleyball net 5, for example via hook(s) 7 that seat upon the top of the net 5 and fastener(s) 8 that engage the bottom of the net 5. Thereby, the frame 3 is stabilized against twisting or turning separate from the vertical and/or horizontal planes of the net 5.

A ball 9 is coupled to a cord 11 coupled to the frame 3 at a connection point 13, such as a rotatable bushing 15. The frame 3 supports the ball 9 rotatable around the connection point 13 above and offset forward of the top of the volleyball net 5. The cord 11 may be, for example, an elastic cord, such as a bungie cord. The ball 9 may be a volleyball with an attachment point 17 sewn and/or adhered. Alternatively, a tetherball type ball 9 formed with an integral attachment point 17 may be applied. The ball 9 may be provided with a diameter and/or weight corresponding to standardized dimensions and weight of an official volleyball.

The frame 3 may be formed including a pair of vertical member(s) 19 spaced apart by at least one cross support 21, for example one cross support 21 proximate the top of the net 5 and one cross support 21 proximate the bottom of the net 5, at the proximal end of each vertical member 19. As best shown in FIG. 2, to position the connection point 13 above and offset forward of the top of the volleyball net 5, an extension 23 may be provided at a distal end of each vertical member 19, an extension cross-bar 25 coupled between the distal end of the extension(s) 23. The extension(s) 23 may be angled upward and away from the top and vertical plane of the net 5 or alternatively project normal to the vertical plane of the net 5. Further, the vertical member(s) 19 may include a bend near the distal end, thus eliminating the need for the extension(s) 23 to be a separate part. The connection point 13 may be provided proximate a midpoint of the extension cross-bar 23. Thereby, when struck towards the net 5, the ball 9 and cord 11 can rotate around the connection point 13 without interfering with/hitting the frame 3, the ball 9 and cord 11 spinning about the extension cross-bar 25 a positive feedback indication to the player that a strong hit was made.

In use, the stability of the approach and hit trainer 1 is dependent upon the characteristics of the volleyball net 5 and its supports (not shown). Although the net 5 can typically easily support the approach and hit trainer 1 vertically, a less than fully tightened net 5 bottom may allow an undesired twisting motion. To minimize twisting movement a floor arm 27 may be coupled to the proximal end of at least one of the vertical member(s) 19. To keep the floor arm 27 from being near the landing area beneath the ball, an offset portion 29 generally parallel to the at least one cross support 21 and a vertical portion 31 may be applied. For use on smooth court surfaces such as gym floors, a suction cup 33 may be applied to the distal end of the vertical portion 31. Alternatively for use on sand courts or the like, the vertical portion 31 may have a spike at the distal end.

The frame 3 may be formed from metal, for example, aluminum alloy tubing and/or angle iron. Reinforcing gussets 35 may be applied to joints between the vertical member(s) 19, extension(s) 23, the extension cross-bar 25 and/or cross supports 21 to improve strength characteristics and/or provide additional coupling surfaces where the frame 3 is made of separable components that are mechanically fastened together at the various joints, for example to minimize the broken down volume of the approach and hit trainer 1 for shipping purposes. Padding 38, such as foam pipe insulation, may be applied to the frame 3 surfaces to minimize the chance for user injury from inadvertent contact with the approach and hit trainer 1 during use.

Mounting of the frame 3 upon the volleyball net 5 is simplified where the hook(s) 7 are provided proximate a mid section of each vertical member 19, enabling the frame 3 to be hung over the top of the net 5, which then supports the frame 3 while the net bottom fastener(s) 8 are applied between the proximal end of the vertical member(s) 19, a bottom cross support 21 and/or gusset 35 and the bottom of the net 5. Further attachment security may be provided by applying hook fasteners 37 closing an open end of at least one of the net 5 top hook(s) 7 around the top of the net 5.

Adjustability for different volleyball net 5 dimensions and/or desired ball 9 positions relative to the net 5 may be incorporated into the approach and hit trainer 1 via multiple connection point(s) 41 along the vertical member(s) 19 for the hook(s) 7 and/or fastener(s) 8 for the bottom of the net 5. Also, the vertical member(s) 19 and/or extension(s) 23 may be formed with multiple alternative attachment points 41 to telescope the height and/or extension of the connection point 13 and thus ball 9 position as desired. Alternatively, the vertical member(s) 19 and or extension(s) 23 may be provided with telescoping inner and outer portions matable at a desired extension with respect to each other for example with cotter-pins or the like.

One skilled in the art will appreciate that in addition to simplifying manufacture of the frame 3, reducing overall materials costs and ease of storage when not in use, compared to prior approach and hit floor mounted trainers, the open landing area of the approach and hit trainer 1 according to the invention greatly increases the types of approach that may be practiced, without repositioning of the approach and hit trainer 1, a significant benefit for a player that is training alone.

Table of Parts

| | |
|---|---|
| 1 | approach and hit trainer |
| 3 | frame |
| 5 | net |
| 7 | hook |
| 8 | fastener |
| 9 | ball |
| 11 | cord |
| 13 | connection point |
| 15 | bushing |
| 17 | attachment point |
| 19 | vertical member |
| 21 | cross support |
| 23 | extension |
| 25 | extension cross-bar |
| 27 | floor arm |
| 29 | offset portion |
| 31 | vertical portion |

-continued

Table of Parts

| | |
|---|---|
| 33 | suction cup |
| 35 | gussett |
| 37 | hook fastener |
| 38 | padding |
| 41 | connection point |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An approach and hit trainer mountable upon a volleyball net having a top and a bottom, the approach and hit trainer comprising:

a frame with a pair of vertical members spaced apart by at least one cross support;

a net bottom fastener proximate a proximal end of each vertical member;

a net top hook proximate a mid section of each vertical member;

an extension at a distal end of each vertical member;

an extension cross-bar coupled between the extensions;

a connection point provided proximate a midpoint of the extension cross-bar;

a cord coupled to the connection point at a first end; and a ball coupled to the cord at a second end;

the cord and the ball rotatable around the connection point.

2. The trainer of claim 1, wherein the connection point is a bushing rotatable around the extension cross-bar.

3. The trainer of claim 1, wherein the frame has a gusset reinforcing the coupling between the vertical members and each cross support.

4. The trainer of claim 1, wherein the frame has a gusset reinforcing the coupling between the vertical members and the extensions.

5. The trainer of claim 1, further including padding on the frame.

6. The trainer of claim 1, wherein the extensions project upward and away from the top of the net.

7. The trainer of claim 1, wherein the extensions project generally normal to a plane of the net.

8. The trainer of claim 1, further including hook fasteners closing an open end of at least one of the net top hooks around the top of the net.

9. The trainer of claim 1, wherein the cord is elastic.

10. The trainer of claim 9, wherein the cord is a bungie cord.

11. The trainer of claim 1, wherein the ball is a tether ball.

12. The trainer of claim 1, wherein the frame is aluminum alloy material.

13. The trainer of claim 1, further including a floor arm coupled to the proximal end of at least one of the vertical members.

14. The trainer of claim 13, wherein the floor arm includes an offset portion generally parallel to the at least one cross support and a vertical portion.

15. The trainer of claim 13, wherein a distal end of the vertical portion has a suction cup.

16. An approach and hit trainer mountable upon a volleyball net having a top and a bottom, the approach and hit trainer comprising:

a frame mountable on the volleyball net, coupled at the top and the bottom;

an extension cross-bar coupled between a pair of extensions of the frame positioning the extension cross-bar offset from a plane of the volleyball net;

a bushing provided proximate a midpoint of the extension cross-bar;

a cord coupled to the bushing at a first end; and a ball coupled to the cord at a second end;

the cord and the ball rotatable around the extension cross-bar.

17. The trainer of claim 16, wherein the cord is elastic.

18. An approach and hit trainer mountable upon a volleyball net having a top and a bottom, the approach and hit trainer comprising:

a ball coupled to a cord coupled to a frame at a connection point;

the frame mountable upon the volleyball net;

the ball retained above and offset forward of the top of the volleyball net, rotatable around the connection point.

19. The trainer of claim 18, wherein the cord is elastic.

* * * * *